United States Patent [19]

Bay et al.

[11] 4,279,420

[45] Jul. 21, 1981

[54] PORTABLE GOLF PRACTICE PLATFORM

[76] Inventors: Marvon Bay, 706 James Blvd., Apt. #5; Norman L. Larson, 706 James Blvd., Apt. #2, both of Worthington, Minn. 56187

[21] Appl. No.: 104,077

[22] Filed: Dec. 17, 1979

[51] Int. Cl.[3] ..... A63B 69/36

[52] U.S. Cl. ..... 273/187 A; 273/195 B; 273/202

[58] Field of Search ..... 273/195 A, 195 B, 187 A, 273/176 H, 176 J, 202, 195 R

[56] References Cited

U.S. PATENT DOCUMENTS

| | | | |
|---|---|---|---|
| 3,406,977 | 10/1968 | Voelkerding | 273/202 |
| 3,430,964 | 3/1969 | Budzinski | 273/202 X |
| 3,633,917 | 1/1972 | Anderson | 273/195 A |
| 3,639,923 | 2/1972 | Stewart | 273/195 B X |
| 3,735,988 | 5/1973 | Palmer et al. | 273/176 H X |
| 3,801,108 | 4/1974 | Murray | 273/195 A X |
| 3,868,109 | 2/1975 | Fowler | 273/187 A |

FOREIGN PATENT DOCUMENTS

| | | | |
|---|---|---|---|
| 472226 | 6/1969 | Switzerland | 273/195 B |

*Primary Examiner*—George J. Marlo
*Attorney, Agent, or Firm*—William H. Maxwell

[57] ABSTRACT

A golf practice platform comprised of a deck marked off in a stance area surfaced with a non-skid coating, and with marginal areas surfaced with replaceable artificial turf simulating turf of fairway depth and of rough depth, there being a series of spaced tees adjustable as to height in the fairway turf area, and all of which is adjustably inclined from horizontal to a substantial slope simulating hillside slopes and upon which the golfer can practice strokes facing any side of the platform as circumstances require.

9 Claims, 11 Drawing Figures

PORTABLE GOLF PRACTICE PLATFORM

BACKGROUND OF THE INVENTION

Golf is a game sport of determination that requires skill pitted against the natural and groomed terrain. For the most part, the golf course is covered with growing grass which varies in depth of growth, the fairways being characterized by hillside slopes and various traps. If the player is reasonably skillful he will remain on the grass covered course comprised of turf of varying depth, some of which is closely mowed and some of which is rather deep and termed rough. However, it is likely that the best golfers will be confronted with difficult shots that will add to their score, unless they are so fortunate as to be able to extricate themselves from said difficulties. For example, a hillside shot may be awkward, and unless the golfer has previously met with such situations or has practiced under such conditions, he may not be able to continue without the expenditure of an extra stroke or two. Accordingly, it is an object of this invention to provide an apparatus in the form of an adjustable platform or platforms that simulate actual hillside conditions with turf of varied depth, in order for the golfer to practice extricating himself from various difficult hillside conditions.

The inclinations of hillside slopes vary in angularity and direction with respect to the right and left handed golfer. For instance, with a given transverse slope, a right handed golfer would face the ball downhill while the left handed golfer would face it uphill, or vice versa. And there are situations where the ball must be driven uphill or downhill; and at various azimuth angles (diagonally) with respect to the hill. In other words, there are an infinite number of combinations of inclination and azimuth angles to be coped with. Accordingly, it is an object of this invention to provide adjustability in a platform to simulate various degrees of inclination and upon which a golfer assumes a stance and drives the ball with an appropriate club. In carrying out this invention, the platform, or adjacently related platforms, can be used flat or in any one of a number of inclined positions, all as hereinafter described.

The primary purpose of this invention is to simulate the turf at angular depositions, and to this end artificial turf covers certain areas of the platform where the ball is to be driven. In practice, it is the margins of the platform that are covered with artificial turf, while the stance area remains unencumbered and coated with a non-skid surface for safe footing. The said stance area is well defined by the artificial turf and marked boundaries as will be described.

In carrying out this invention there are turf areas of varied thickness; a fairway turf of a depth simulating grass that has been groomed and uniformly mowed; and a rough turf of unusual depth simulating grass that has not been mowed and which is therefore rangy. The fairway depth of turf may be used as is or with tees adjusted to height as circumstances require. The rough depth of turf may be used by placing or pressing or imbedding the ball therein as circumstances require. By selectively utilizing the varied thicknesses of turf with or without tees, the golf ball and club action will simulate the actual natural grass condition and the inclined stance area will simulate actual natural slope conditions.

SUMMARY OF INVENTION

This invention relates to "perfection by practice" of the game of golf, through the use of the Portable Golf Practice Platform herein disclosed and which comprises an adjustably tiltable deck having an inside stance area surrounded by turf areas with artificial turf of varied thickness or depth. Tees of adjustable height project through the fairway turf for practicing initial drive strokes, there being a plurality of tees incrementally positioned along the turf adjacent to the stance area for advancing and retracting the position of the ball relative to the stance of the golfer. Normally, a golfer replaces turf that becomes dislodged, and accordingly realistic practice upon the platform of the present invention will also result is dislodgement of the artificial turf. Accordingly, it is another object of this invention to provide for replacement of turf if it becomes damaged beyond repair.

The foregoing and other various objects and features of this invention will be apparent and fully understood from the following detailed description of the typical preferred form and applications thereof, throughout which description reference is made to the accompanying drawings.

Figure 7:
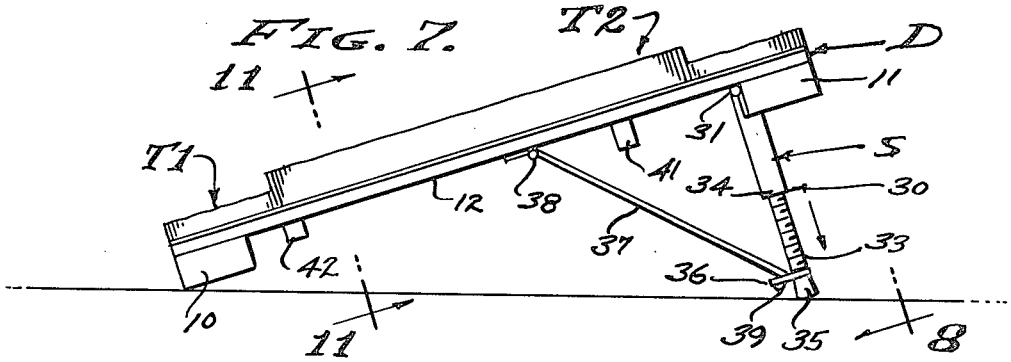
FIG. 7 is an enlarged side elevation taken as indicated by line 7—7 on FIG. 4.
Figure 8:
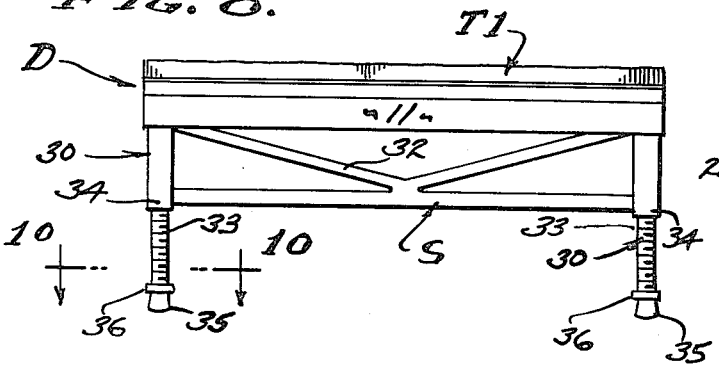
FIG. 8 is an end view of the inclined platform and taken as indicated by line 8—8 on FIG. 7.
Figure 9:
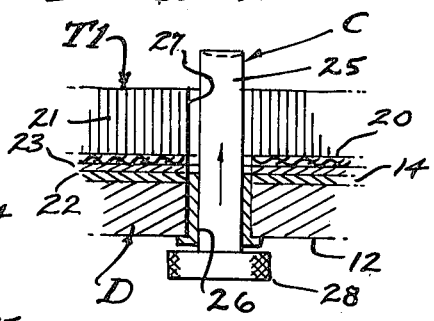
FIG. 9 is an enlarged fragmentary sectional view of the adjustable tee, and taken as indicated by line 9—9 on FIG. 5.
Figure 10:
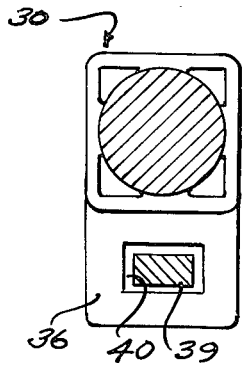
FIG. 10 is an enlarged sectional view taken as indicated by line 10—10 on FIG. 8.
Figure 11:
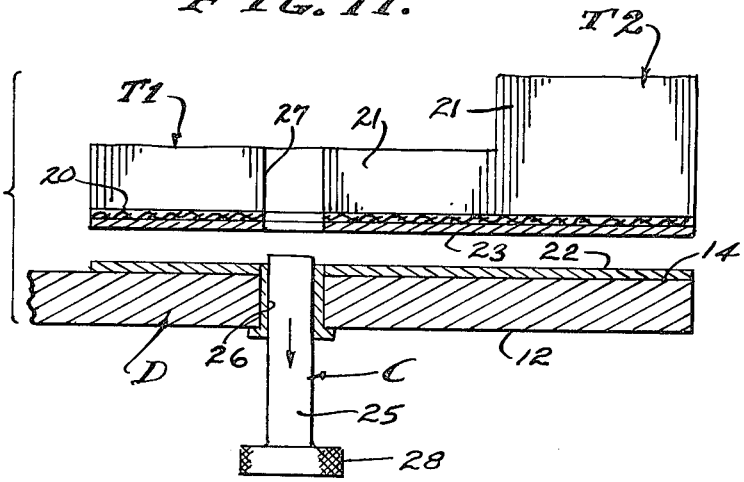

And, FIG. 11 is an enlarged exploded view taken substantially as indicated by line 11—11 on FIG. 7.

PREFERRED EMBODIMENT

Figure 1:
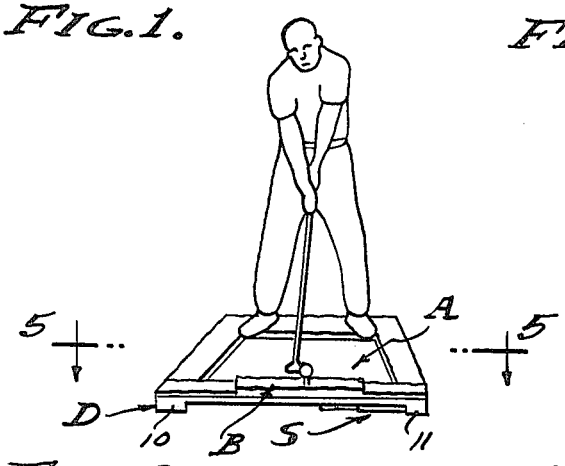
FIGS. 1 through 4 are perspective views showing four typical stances used by the golfer when employing the Practice Platform of the present invention.
Figure 2:
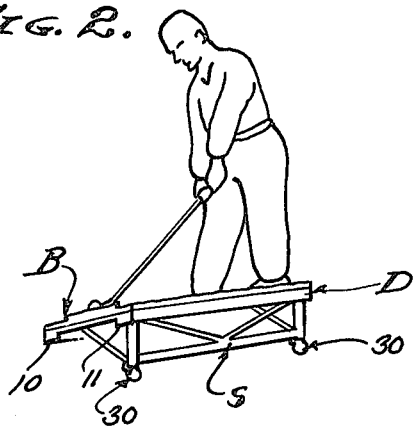
Figure 3:
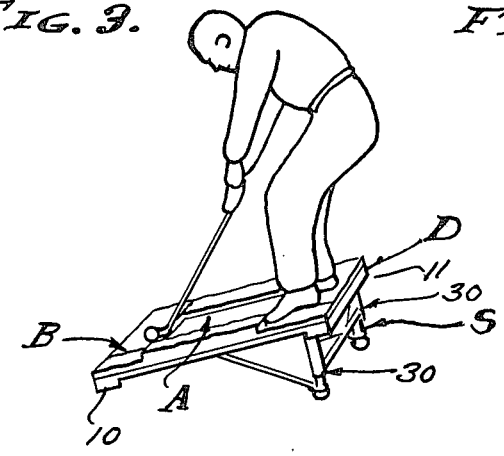
Figure 4:
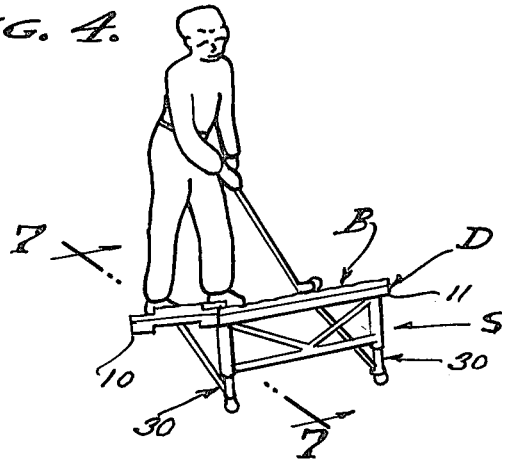
Figure 5:
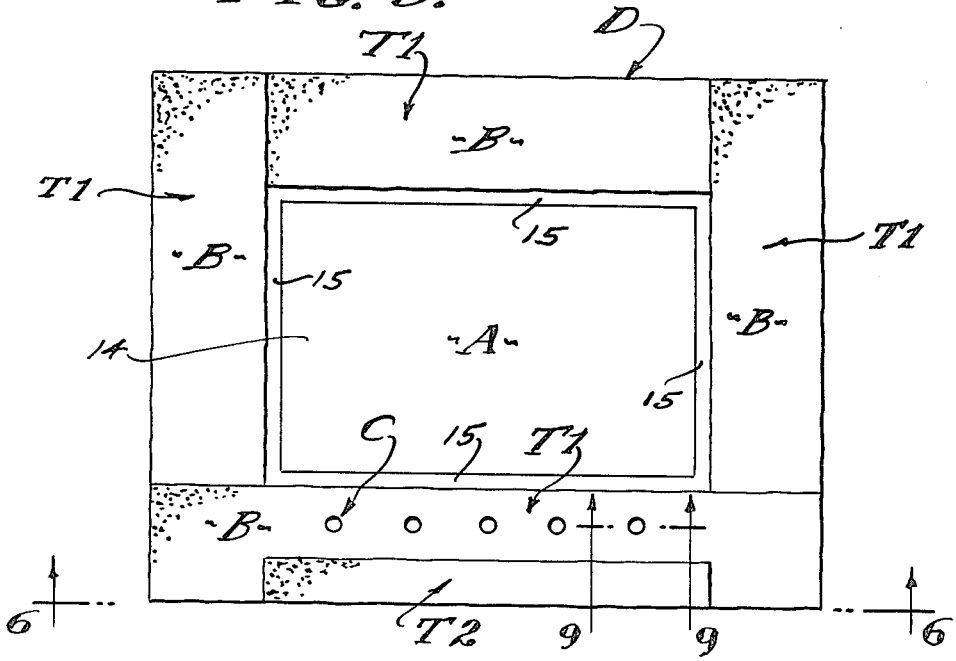
FIG. 5 is an enlarged plan view taken as indicated by line 5—5 on FIG. 1.
Figure 6:
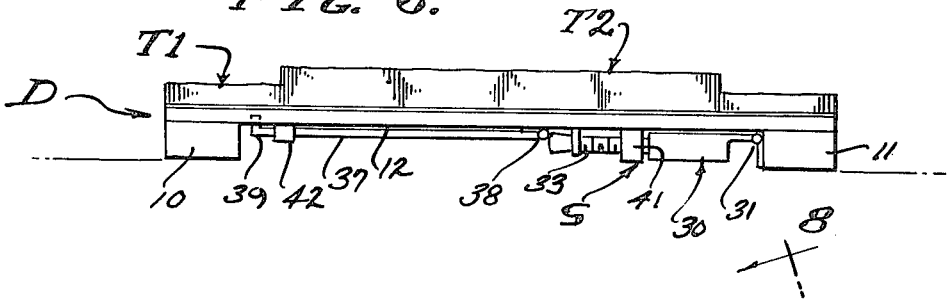
FIG. 6 is a side elevation view taken as indicated by line 6—6 on FIG. 5.

The Portable Golf Practice Platform of the present invention is essentially a flat deck D with a collapsible support S that is adjustable. The deck is characterized by a stance area A surrounded by marginal turf areas B onto which artificial turf T1 and T2 is replaceably applied. A feature is the arrangement of a series of spaced tees C along one side margin of the deck D. Referring to FIGS. 1-4 of the drawings, the typical practice stances are shown; FIG. 1 showing the initial teeing-off stance with the deck of the platform horizontally disposed; FIG. 2 showing an uphill stance (tees retracted); FIG. 3 showing a downhill faced stance; and FIG. 4 showing an uphill faced stance. All stances shown herein are for right handed golfers, it being understood that left handed golfers face oppositely.

The deck K is a flat planar element of rectangular configuration and of a stiffness to remain flat when subjected to the weight impressed thereon by the feet of the golfer. In practice, for example, a sheet of $\frac{3}{4}$ inch plywood will suffice, reinforced by rails 10 and 11 at its inner and outer edges. The rails 10 and 11 are fastened to the botton side 12 of the deck to project therefrom and to establish ground or floor engagement. The upper side 14 of the deck D is marked off in stance and turf areas as next described. In carrying out this invention, the side edges of deck D are longer than the aforementioned inner and outer edges, an increase commensurate with the width of the rails 10 and 11; for example establishing a deck measurement of 28 by 36 inches.

There are marginal turf areas B extending along each side of the deck D, with the stance area A surrounded or encompassed thereby. In carrying out this invention, the marginal turf areas B are 6 to 8 inches wide and are adapted to be coextensively covered with artificial turf T1 and/or T2. It will be observed that a section of turf T1 of fairway depth extends along one long side area of the deck D, and shorter sections of turf T1 fully occupy the remaining three side areas. Accordingly, the stance area A is defined by the turn and lines or bands of demarcation 15 extending adjacent to the inside edges of the turf areas B, and to which the footing and namely the toes of the golfer are positioned for the normal strokes as shown in FIGS. 1–4; a normal stroke being one in which the golfer faces across the deck D as shown in the drawings. However, it is to be understood that diagonal strokes may also be practised.

The turf sections T1 and T2 are of runner configuration comprised of artificial turf made of plastic materials having a heavy substantially stiff backing 20 and upwardly standing filiments 21 having individual cross section and flexibility simulating blades of grass. As shown, the runner sections are elongated rectangular mats superimposed over and lying flat upon the marginal turf areas B. Securement of the turf sections T1 and T2 is preferably releasible, and as shown a hook and loop fastener means is employed; utilizing the product "VELCRO" as manufactured by Velcro USA INC. of 681 Fifth Avenue, New York, N.Y. 10022. As shown therefore, the flat layer of loop material 22 is permanently secured to the end portions of the marginal areas B as by means of a cement or an adhesive (not shown). The flat opposing layer of hook material 23 is permanently secured to the complementary end portions of the backing 20 as by means of a cement or an adhesive (not shown). The opposing elements 22 and 23 coextensively engage one with the other as shown and indicated in the drawings. The remaining areas between the securement element 22 and the entire stance area A are coated with a non-skid surfacing, indicated on the drawings by stippling.

The turf area B and its overlying artificial turf T1 extends along what will be referred to as the right side of the platform, most golfers being right handed. Turf T1 is of fairway depth, and is that turf from which the golfer tees off. Accordingly, there are tees associated with this turf section, a series of tees C equally spaced therealong in a line parallel to and adjacent the edge juxtaposed to the line or band of demarcation 15 setting off the boundary of stance area A. Adjacent to the tees and extending along the outside portion of Turf T1 the turf filiments 21 are of rough depth designated T2, so that turf section T1 serves triple purposes, including fairway driving with or without a tee and rough strokes.

Referring now to adjustability of the tees C, each tee is comprised of a plunger 25 slideably engaged through an opening 26 through the deck D and passing through a port 27 in the artificial turf. A manually engageable control knob 28 is at the lower end of the plunger beneath the deck D, to raise and lower the same, and the top end of the plunger is concaved to receive and place the golf ball adjusted as to height. The plunger is retractile and replaceable.

Referring now to angular adjustment of the platform deck D, a pair of retractile legs 30 are mounted at the outer end of the deck D. The pair of legs are joined together to swing in unison about a common hinge axis 31, to lie flat against the underside of deck D or to swing therefrom. The legs 30 are joined by cross braces 32, with the hinge axis at the corner formed by the rail 11 and underside of deck D. Each leg 30 has an extension screw 33 telescopically threaded through a nut 34 to extensibly retract into the leg. The bottom end of leg screw 33 carries a crutch tip 35, there being a tab 36 projecting laterally of the screw and by which it can be turned manually for up and down adjustment. Struts 37 swing downward from deck D, from a pivot 38 remote from the leg hinge axis and with a hook 39 to engage an opening 40 in the tab 36 so as to locate the leg. The legs 30 and struts 37 swing upward to lie flat against the underside of deck D, and are held thereto by snaps 41 and 42 or other suitable fastener means.

From the foregoing it will be seen that we have provided a straight forward practice apparatus for improving difficult and awkward golf strokes. The platform can be used flat as it is shown in FIG. 1, or it can be angularly inclined as shown in FIGS. 2–4. The initial angular inclination of FIG. 2 is for simulating a hillside slope of nominal magnitude, it being understood that a lesser inclination is not of particular significance. However, the inclination of FIGS. 3 and 4 are greater than that of FIG. 2 and the latter greater than the former. The adjustment between the examples of FIGS. 3 and 4 is infinite. It will be apparent that four basic strokes normal to or transverse to the platform are shown for a right handed golfer and that these strokes are duplicated for a left handed golfer; and also that an infinite number of diagonal strokes can be performed.

Having described only a typical preferred form and application of our invention, we do not wish to be limited or restricted to the specific details herein set forth, but wish to reserve to ourselves any modifications or variations that may appear to those skilled in the art as set forth within the limits of the following claims:

We claim:

1. A portable golf stroke practice platform including, a deck of flat rectangular configuration having marginal areas covered with artificial turf of an upstanding filiment depth simulating natural fairway turf, there being a central stance area devoid of said artifical turf and surrounded by said marginal areas and defined by lines of demarcation to which the golfer positions his footing while standing upon the marginal area covered with said marginal turf and facing a golf ball to be driven at an opposite marginal area of said artificial turf.

2. The portable golf stroke practice platform as set forth in claim 1, wherein the artificial turf at one of said marginal areas is of an upstanding filiment depth greater than the others in order to simulate rough turf.

3. The portable golf stroke practice platform as set forth in claim 1, wherein the artificial turf is of an upstanding filiment depth simulating natural fairway turf, there being at least one tee projecting from the deck and through said artificial turf to position the golf ball for the stroke.

4. The portable golf stroke practice platform as set forth in claim 1, there being at least one vertically adjustable tee slideably projecting through an opening in the deck and from said artificial turf to position the golf ball for the stroke.

5. The portable golf stroke practice platform as set forth in claim 1, there being a series of tees spaced along one of said marginal areas and projecting from the deck and through said artificial turf and selectively moveable to position the golf ball for the stroke.

6. The portable golf stroke practice platform as set forth in claim 1, there being a series of equally spaced tees along one of said marginal areas and vertically adjustable slideably through openings in the deck and projecting from said artificial turf and selectively useable to position the golf ball for a stroke.

7. A portable and adjustably inclinable golf stroke practice platform including, a deck of flat rectangular configurations having marginal areas covered with artificial turf of upstanding filiment depth simulating natural fairway turf, there being a stance area devoid of said artificial turf and surrounded by said marginal areas and defined by lines of demarcation to which the golfer positions his footing while standing upon the marginal areas covered with said artificial turf and facing a golf ball to be driven at an opposite marginal area of said artificial turf, and a retractile leg support depending from one marginal area of the deck to support and raise the same while the edge of the opposite marginal area also supports the same for adjusted angular inclination of the platform.

8. The portable and adjustably inclinable golf stroke practice platform as set forth in claim 7, wherein the said retractile leg support comprises a pair of legs and one at each corner of the side along which said one marginal area extends, and a retractile strut engageable with the leg support to position the same depending from the deck.

9. The portable and adjustably inclinable golf stroke practice platform as set forth in claim 7, wherein the said retractile leg support comprises a pair of legs and one at each corner of the side along which said one marginal area extends, a retractile strut engageable with the leg support to position the same depending from the deck, and wherein each of said legs is extensible by telescoping screw means in said depending position.

* * * * *